United States Patent [19]

Long et al.

[11] 4,438,531

[45] Mar. 27, 1984

[54] LOW FRICTION MEANS TO FACILITATE PUTTING ON AN UNDERWATER DIVING SUIT

[75] Inventors: Richard W. Long; Robert T. Stinton, both of San Diego, Calif.

[73] Assignee: Diving Unlimited International, Inc., San Diego, Calif.

[21] Appl. No.: 372,479

[22] Filed: Apr. 28, 1982

[51] Int. Cl.[3] ..... A62B 17/00; B63C 11/04

[52] U.S. Cl. ..... 2/2.1 R

[58] Field of Search ..... 2/2.1 R, 2.1 A, 272

[56] References Cited

U.S. PATENT DOCUMENTS 2,981,954 5/1961 Garbellano ..... 2/2.1 R
3,428,960 2/1969 Schueller ..... 2/2.1 R
3,731,319 5/1973 O'Neill ..... 2/2.1 R

FOREIGN PATENT DOCUMENTS 978961 1/1965 United Kingdom ..... 2/2.1 R

*Primary Examiner*—Louis Rimrodt
*Attorney, Agent, or Firm*—Brown & Martin

[57] ABSTRACT

An underwater diving suit construction that provides skirts of low friction material adjacent the openings through which the diver inserts his head, hands and feet. This greatly facilitates getting into the suit and reduces the discomfort which normally accompanies this action without requiring specials aids such as greases and powders and greatly increases the life and dependability of the seals and thereby the suit.

6 Claims, 5 Drawing Figures

LOW FRICTION MEANS TO FACILITATE PUTTING ON AN UNDERWATER DIVING SUIT

BACKGROUND OF THE INVENTION

The present invention relates to an underwater diver's suit. Diver's suits are difficult to put on. The various openings in the suit such as the openings around the ankles, the openings around the wrists and the opening around the neck must be snug in order to be watertight. However, in order to get the seals in place, the diver must push his feet, his hands and his head through the seals which are smaller in size than the diver's body portion being inserted through them. The friction of the seal, which is usually rubber, passing over the skin is significant and causes skin irritation. Currently, divers spray large amounts of silicone compound in the seal area in order to get their hands and feet through the seals. Because of the large amount of hair on the head of most divers, this approach is less effective and in some cases a nylon lining is used on the seal. However, this detracts from the effectiveness of the seal when it is in place.

The diver finds the above practice cumbersome and frustrating.

It is an object of the present invention to provide new and improved low friction interface means for an underwater diver's suit that is simple and effective in use.

It is another object of the present invention to provide new and improved low friction interface means for an underwater diver's suit having seals that is easy to use and that avoids the discomfort associated with the frictional contact by the diver's skin and hair with the seals when putting on the suit.

It is a further object of the present invention to provide a new and improved low friction interface means for an underwater diver's suit having seals that facilitates putting on and taking off the suit and that is stored away from the seal when the seal is in place, said interface increasing the lift and dependability of the seal.

SUMMARY OF THE INVENTION

The disadvantages of the current sealing arrangements in the diver's suit are overcome by an exemplary embodiment of the invention wherein skirts of low friction material are attached adjacent the seals and are adapted for contacting the parts of the diver's body inserted through the seals as the diver puts on the suit and which are storable within the suit after the suit is put on to accommodate effective sealing.

DETAILED DESCRIPTION OF THE INVENTION

Figure 1:
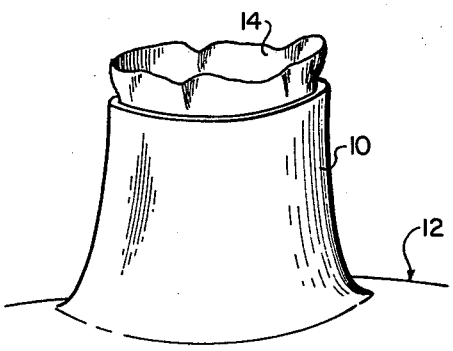
FIG. 1 is a partial view of an underwater diver's suit showing the neck portion with the low friction skirt of the present invention in place.
Figure 2:
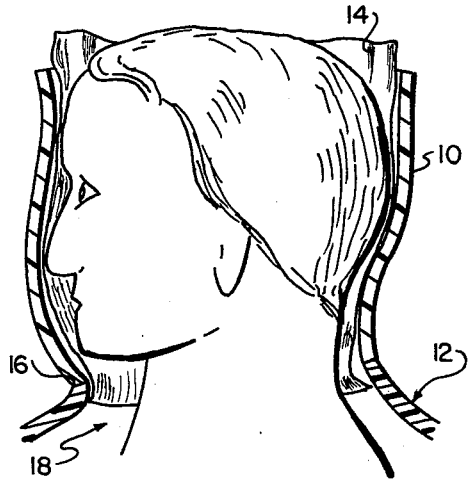
FIG. 2 is a side view, partly in section, of the construction shown in FIG. 1 with a diver's head being inserted through the opening.

FIGS. 1 and 2 of the drawings show the neck portion 10 of an underwater diving suit 12. The neck portion 10 is formed of rubber so that it will create a good watertight seal when it is worn by the diver. A tube or skirt 14 of low friction material, such as nylon or other smooth, synthetic material for example, is attached at 16 inside the neck portion 10 at the base thereof. When the suit 12 is in use, the skirt 14 folds down inside the suit.

When the diver, shown at 18 in FIG. 2, puts the suit on, he must insert his head up through the neck portion 10. Without the skirt of the present invention, the rubber neck portion 10 of the suit engages his hair, ears and face. The frictional contact of the suit material is very uncomfortable, particularly when it pulls on the hair. With the low friction skirt 14, this problem is avoided. The skirt 14 is moved up through the neck portion 10 and provides a low friction path for the diver to insert his head. The suit slips easily over the driver's head with a minimum of frictional contact and discomfort. There is no need for silicone grease, talc or other material when putting on the suit.

Figure 3:
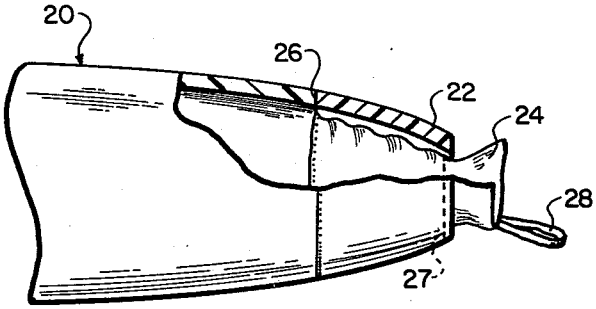
FIG. 3 is a partial side view of a sleeve portion of an underwater diver'suit, partly sectioned, with the low friction skirt of the present invention in place.
Figure 4:
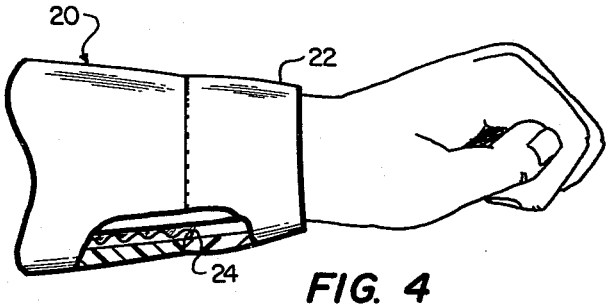
FIG. 4 is a side view similar to FIG. 3 showing the diver's hand extending through the sleeve portion of the diving suit with the low friction skirt stored in the sleeve.

FIGS. 3 and 4 show the skirt of the present invention applied to a sleeve 20 of the diving suit 12. The sleeve is made of rubber and tapers at the end to provide a cone type seal 22. This seal must be small enough so that it effectively seals against water leakage when the diver's arm is in the sleeve. Again, the problem of skin irritation and pulling of the hair on the back of the diver's hand and lower arm portion becomes a problem. A low friction skirt 24 is attached to the interior of the sleeve 20 at 26 and is normally tucked into the sleeve when the suit is stored. When the driver puts on the suit, he reaches his finger into the end of the sleeve and hooks his finger into the loop or tab 28 which is attached to the end of skirt 24. The skirt 24 is pulled out the end of the sleeve and the diver may now insert his hand through the end of the sleeve and it slides easily along the skirt 24 without the usual irritation. When removing the suit, the loop 28 is grasped and pulled out the end of the sleeve. Talcum, silicone spray and other such measures are avoided. The use of sprays and the like destroy the seal, collect dirt, and cause premature fatigue and failure of the seal. The diver then tucks the skirt 24 back into the sleeve 20 as shown in FIG. 4 of the drawings. The cone seal engages the diver's wrist and seals against water leakage. This same type of arrangement is used at the end of the legs in the diver's suit. Although FIG. 3 of the drawings shows the skirt 24 extending completely out of the sleeve 20, it may extend just short of the end of the sleeve as shown by dotted line 27.

Figure 5:
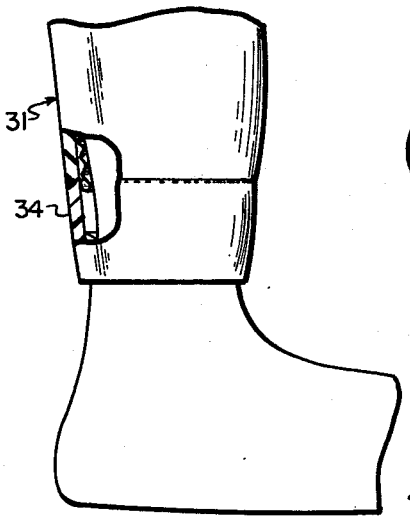
FIG. 5 is a side view similar to FIG. 4 showing the diver's foot extending through the leg portion of the diving suit with the low friction skirt stored inside the leg portion.

FIG. 5 shows a portion of the leg 31 of the diving suit 12 after the suit has been put on and with the skirt 34 in the stored position after it has been used to provide a low friction path for the diver's foot when putting on the diving suit.

The present invention provides an integrated low friction means in the diving suit so that the diver can put the suit on easily and comfortably without aids such as powders and sprays while maintaining the integrity of the seals.

Having thus described our invention, we claim:

1. In an underwater diving suit having an opening therein to permit a diver to insert a portion of the diver's body therethrough when putting on the suit, said opening having tight fitting exposed rubber sealing means adjacent thereto for sealing the interior of the diving suit against leakage, the improvement comprising:

a tubular skirt of flexible low friction material affixed at one of its ends to the interior of said diving suit adjacent said exposed rubber sealing means, said skirt being of sufficient length to substantially cover said exposed rubber sealing means when said unit is being put on;

whereby the diver's body portion slides along said skirt shielded from said exposed rubber sealing means with frictional drag substantially reduced when the diver puts on the diving suit;

said skirt being manually retractable into the diving suit after the diving suit is put on to permit said exposed rubber sealing means to directly engage the diver's body portion and thereby seal the interior of the diving suit against leakage.

2. The improvement in an underwater diving suit according to claim 1 wherein the skirt includes tab means thereon to facilitate pulling out of the skirt from inside the diving suit.

3. The improvement in an underwater diving suit according to claim 1 wherein said low friction interface means is made of a low friction, smooth synthetic material.

4. The improvement in an underwater diving suit according to claim 1 wherein said low friction interface means is positioned near the neck opening and neck sealing means in said diving suit.

5. The improvement in an underwater diving suit according to claim 1 wherein said low friction interface means is positioned near the wrist opening and wrist sealing means in said diving suit.

6. The improvement in an underwater diving suit according to claim 1 wherein said low friction interface means is positioned near the ankle opening and ankle sealing means in said diving suit.

* * * * *